US005167847A

United States Patent [19]

Olavesen et al.

[11] Patent Number: 5,167,847

[45] Date of Patent: Dec. 1, 1992

[54] PROCESS FOR PRODUCING TRANSFORMER OIL FROM A HYDROCRACKED STOCK

[75] Inventors: Christopher Olavesen, Clearwater; Kevin D. Butler, Sarnia, both of Canada

[73] Assignee: Exxon Research and Engineering Company, Florham Park, N.J.

[21] Appl. No.: 526,258

[22] Filed: May 21, 1990

[51] Int. Cl.[5] ..... C10M 133/00

[52] U.S. Cl. ..... 252/50; 252/52 R; 252/399; 252/401; 208/58; 208/89; 208/92; 208/264

[58] Field of Search ..... 208/89, 264, 92, 58; 252/50, 52 R

[56] References Cited

U.S. PATENT DOCUMENTS

| | | | |
|---|---|---|---|
| 3,365,390 | 1/1968 | Egan et al. | 206/60 |
| 3,642,609 | 2/1971 | Mayer et al. | 208/33 |
| 3,644,195 | 2/1972 | Gudelis et al. | 208/33 |
| 3,663,422 | 5/1972 | Dun et al. | 206/28 |
| 3,681,230 | 8/1972 | Eagen et al. | 208/33 |
| 3,684,695 | 8/1972 | Noel et al. | 206/110 |
| 3,773,650 | 11/1973 | Hislop et al. | 208/33 |
| 3,775,288 | 11/1973 | Eagen et al. | 208/33 |
| 3,779,894 | 12/1973 | Eagen et al. | 208/33 |
| 3,850,740 | 11/1974 | Gudelis et al. | 208/33 |
| 3,871,991 | 3/1975 | Shaw | 208/33 |
| 3,896,025 | 7/1975 | Coleman et al. | 208/95 |
| 4,013,542 | 3/1977 | Gudelis et al. | 208/33 |
| 4,018,666 | 4/1977 | Reid et al. | 208/36 |
| 4,062,791 | 12/1977 | Masunaga et al. | 252/63 |
| 4,069,165 | 1/1978 | Masunaga et al. | 252/63 |
| 4,111,790 | 9/1978 | West | 208/33 |
| 4,124,489 | 11/1978 | Reid | 208/87 |
| 4,146,461 | 3/1979 | Broadhurst et al. | 208/33 |
| 4,664,775 | 5/1987 | Maejima et al. | 208/89 |

FOREIGN PATENT DOCUMENTS

| | | |
|---|---|---|
| 255741 | 4/1988 | German Democratic Rep. . |
| 1440230 | 6/1976 | United Kingdom . |
| 1493928 | 11/1977 | United Kingdom . |

*Primary Examiner*—Prince Willis, Jr.
*Assistant Examiner*—Ellen McAvoy
*Attorney, Agent, or Firm*—Joseph J. Allocca

[57] ABSTRACT

The present invention is directed to the production of a formulated transformer oil by the process involving fractionating the product coming from a hydrocracker to produce a distillate boiling in the transformer oil range, dewaxing the fraction, optionally hydrofinishing the fraction and adding to said fraction an effective amount of anti-oxidant and/or pour point depressant. The formulated transformer oil produced by this process has properties equivalent to those of formulated naphthenic transformer oil.

18 Claims, No Drawings

PROCESS FOR PRODUCING TRANSFORMER OIL FROM A HYDROCRACKED STOCK

DESCRIPTION OF THE INVENTION

Formulated transformer oils are produced from hydrocracked stock by the process comprising the steps of fractionating a hydrocracked paraffinic petroleum hydrocarbon and recovering a distillate boiling in the transformer oil range, solvent dewaxing the fraction, optionally hydrofinishing the fraction, and adding to the said fraction an effective amount of anti-oxidant and/or pour point depressant additives. The formulated transformer oil produced by this process has properties equivalent to those of formulated naphthenic transformer oil.

BACKGROUND OF THE INVENTION

Transformer oils are formulated so that they may meet or exceed certain specific, performance conditions exemplified by ASTM D3487 and CSA C-50 requirements. These conditions include a minimum pour point, a maximum kinematic viscosity and enumerated limits on interfacial tension, gassing tendency and levels of acid number and sludge produced at 24 and 164 hours in the ASTM D2440 oxidation test. In the past only transformer oils produced from extracted-hydrofinished naphthenic distillates met or exceeded the demanded performance characteristics.

Attempts have been made to produce transformer oils from feed stocks other than naphthenic oils.

U.S. Pat. No. 4,124,489 teaches a process for producing transformer oil by double solvent extracting a raw, untreated, light distillate fraction from a waxy crude oil to produce a second, wax containing extract oil. This second extract oil is hydrotreated to mildly crack it, reduce the sulfur content and improve the viscosity, oxidation and color stability. This hydrotreated oil is then distilled to produce a transformer oil feedstock of relatively low wax content as a heart cut fraction having a 5 to 95 LV% boiling range between about 595° to 750° F. The transformer oil feedstock may then be dewaxed using any well known method such as solvent or catalytic dewaxing to obtain a low pour point transformer oil.

U.S. Pat. No. 4,018,666 teaches a process for producing a very low pour point transformer oil by a process wherein a narrow cut distillate of a paraffinic crude from conventional crude oil atmospheric or vacuum towers is first solvent extracted to remove aromatics and polar components, followed by immiscible solvent dewaxing whereby two liquid and one solid phases form a wax-containing slurry which is filtered to produce a wax cake which contains a high viscosity index oil and a filtrate which contains a very low pour point transformer oil.

U.S. Pat. No. 4,062,791 teaches an electrical insulating oil having excellent oxidation stability, thermal stability, corona resistance, corrosion resistance and a low pour point. This oil consists essentially of a blend of a solvent extracted, hydrofined and dewaxed oil derived from a paraffin or mixed base crude oil, a solid adsorbent treated oil prepared from a lubricating oil fraction of a mineral oil, at least one arylalkane such as alkylbenzene and, if desired, an essentially amorphous ethylene propylene copolymer. The oil has a sulfur content of not more than 0.35 wt%.

U.S. Pat. No. 4,069,165 teaches an electrical insulating oil consisting essentially of a mineral oil containing not more than 0.35 wt% sulfur prepared by solvent extracting, hydrofining, and dewaxing a distillate containing at least 80 wt% of a fraction boiling at 230° to 430° C. at atmospheric pressure, the distillate being obtained by the distillation of paraffins or mixed base crude oils, at least one arylalkane and if desired a hydrocarbon derived pour point depressant.

U.S. Pat. No. 4,664,775 teaches a method for manufacturing low pour point petroleum products from paraffin base oils using a zeolite for the catalytic dewaxing step.

U.S. Pat. No. 3,684,695 teaches a process for hydrocracking an oil to produce high viscosity index lubricating oils. A high boiling hydrocarbon oil, such as a deasphalted residual oil is hydrocracked over a catalyst, a liquid product boiling in the 350° to 550° range is recovered and dewaxed.

U.S. Pat. No. 3,365,390 teaches a process for producing lubricating oils. The lube oil is produced by hydrocracking a heavy oil feed, separating hydrocracked wax, hydroisomerizing the hydrocracked wax, dewaxing the isomerate by itself or in admixture with the hydrocracked lube oil portion. An additional hydrogenation step may precede and/or follow the wax isomerization step.

GB 1,440,230 teaches a process for preparing lube oils. The process involves catalytic hydrocracking a high boiling mineral oil fraction (e.g. a vacuum distillate boiling at between 350° and 500° C. or a deasphalted residual oil). After hydrocracking the hydrocarbons boiling below the range between 350° and 400° C. are removed by distillation and the higher boiling residua is dewaxed yielding a high VI lube oil. The wax is hydroisomerized to increase the yield and improve the VI of the final oil product.

GB 1,493,928 teaches a process for the conversion of hydrocarbons. Lubricating oils are produced by the catalytic hydrocracking of heavy hydrocarbons, said heavy hydrocarbons consisting at least partially of one or more foots oils and, optionally, of other heavy fractions selected from waxy lube oil fractions obtained during the distillation under reduced pressure of atmospheric distillation residues of waxy crudes, slack waxes separated from the aforesaid waxy lube oils or slack waxes separated from waxy lube oils obtained by hydrocracking.

The Present Invention

It has been discovered that excellent formulated transformer oil can be produced from paraffinic oil sources by hydrocracking the paraffinic oil, fractionating the hydrocracked petroleum hydrocarbon oil to recover a distillate boiling in the transformer oil range, solvent dewaxing this fraction, optionally hydrofinishing the dewaxed fraction and adding an effective amount of anti-oxidant and/or pour point depressant additive. The formulated transformer oil produced by this method possesses properties generally equivalent to those of formulated naphthenic transformer oil and meeting the requirements established by industry for transformer oils.

It is surprising that transformer oils can be produced from paraffinic oil sources by hydrocracking because hydrocracking is commonly viewed as a fuels operation or one which can be employed to produce lubricating oils of high viscosity index. The properties required for good transformer oils are not necessarily the same as those which are possessed by fuels or even lube oils. It is entirely unexpected that a hydrocracked paraffin oil can be fractioned, dewaxed, optionally hydrofinished and combined with anti-oxidant and/or pour point depressant additives to produce an acceptable transformer oil because inspection of the hydrocracked paraffin fraction reveals that it possesses extremely low sulfur content and low aromatics content. Despite this the oil exhibited, when formulated, outstanding oxidation stability and acceptable gassing tendencies. Furthermore, the hydrocracked paraffin oil transformer oil fraction, although dewaxed at a filter temperature of −21° C., exhibited an unformulated pour point of −33° C., and it pour depressed to give excellent fluidity at −40° C.

In the process of the present invention the feed to the hydrocracker can be any combination of refinery streams, with a significant portion (e.g. 20 LV% and higher) boiling higher than 350° C. This is so because the normal mid-boiling point of transformer oils is in the 320° C. to 350° C. range.

The composition of the feed is not critical and can include any combination of virgin atmospheric or vacuum distillates, distillates from conversion units such as cokers or visbreakers, lube extracts, wax streams and even mixtures thereof. Highly paraffinic streams are entirely suitable. Typical of useful crude sources is Western Canadian Crude.

The feed is hydrocracked under fairly standard hydrocracking conditions. These conditions are characterized in terms of the severity of the operation to convert feed into material boiling lower than 350.C. These conditions are presented in Table 1 below.

TABLE 1

| HYDROCRACKING CONDITIONS | BROAD RANGE | PREFERRED |
|---|---|---|
| LIQUID HOURLY SPACE VELOCITY, V/V/H | 0.2–2.0 | 0.5–1.0 |
| PRESSURE, PSIG | 500–3000 | 1500–2500 |
| HYDROGEN PURITY, LV % | 50–100 | 70–100 |
| HYDROGEN TREAT RATE, SCF/B | 3000–12000 | 5000–12000 |
| CONVERSION TO 350° C.- | 50–100 | 70–100 |

The catalyst employed in the hydrocracker can be any of those commonly used in petroleum hydroprocessing. They can include the typical amorphous based catalysts, e.g. Ni/Mo, Co/Mo, Ni/Co/Mo and Ni/W on alumina or silica alumina, as well as Gp VI and/or Gp VIII metal loaded zeolites such as faujasite, zeolite X, zeolite Y or a combination of the aforesaid amorphous based and zeolite based catalysts.

The hydrocrackate is then fractionated to recover that portion boiling in the transformer oil boiling range, i.e. 270°–375° C., preferably 300° to 375° C. (GCD 5/95-LV% points).

These distillate fractions are then solvent dewaxed by chilling to about −24° C. and filtering at a filter temperature of −21° C. employing any of the typical solvent dewaxing processes using any of the usual dewaxing solvents. Exemplary of such solvent dewaxing processes are the DILCHILL dewaxing process of U.S. Pat. No. 3,773,650, U.S. Pat. No. 3,644,195 and U.S. Pat. No. 3,642,609; the DILCHILL dewaxing plus scraped surface chiller process of U.S. Pat. No. 3,775,288 as well as numerous variations on the DILCHILL dewaxing process covered by the following U.S. Pat. Nos.: 3,681,230, 3,779,894, 3,850,740, 4,146,461, 4,013,542, 4,111,790, 3,871,991, all of which are hereby incorporated by reference. Autorefrigerative dewaxing processes employing liquified, normally gaseous hydrocarbons are also embraced in the present process. Such autorefrigerative processes include those using propane, propylene, butane, butylene, etc. and mixtures thereof.

The dewaxed hydrocrackate fraction boiling in the transformer oil boiling range can, optionally, be hydrofinished. This hydrofinishing step should be performed over amorphous base catalysts such as Co/Mo or Ni/Mo on alumina, at a pressure in the range 200 to 500 psig, temperature in the range 200° to 350° C., gas rate (pure hydrogen) of 200 to 2000 SCF/bbl and a space velocity in the range 0.2 to 3.0 v/v/hr.

Hydroprocessing is practiced when it is determined that it is necessary to clean-up processing artifacts and other contaminants which might affect key properties, in particular water, although water can also be removed with a vacuum drier.

Following the dewaxing step, and any optional hydrofinishing step, the hydrocrackate boiling in the transformer oil boiling range is combined with an effective amount of anti-oxidant and/or pour point depressant additives commonly used in transformer oils. An example of a typical anti-oxidant is 2,6-di-t-butyl paracresol. However, the use of such anti-oxidants is limited. ASTM D3487 describes Type I oils as being restricted to a maximum of 0.08 wt% oxidation inhibitor while Type II oils are limited to a maximum of 0.3 wt% oxidation inhibitor. Pour point depressants are exemplified by Pearsall OA 100A, an alkylated polystyrene. Such pour point depressants are used in an amount ranging from about 0.01 to 2.0 wt%, preferably 0.1 to 1.0 wt%.

Anti-oxidants must be free-radical traps, to act as free-radical reaction chain breakers. Phenolics are generally used, but amines and nitrogen heterocycle metal deactivators are used under special circumstances.

Pour depressants should be non-polar in order to avoid affecting the electrical properties of transformer oil. All come under the general description of alkylated aromatic polymers.

EXAMPLES

The following examples are offered only as illustrations of the present invention and for comparative purposes, and not as limitations on the present invention.

A Western Canadian paraffinic crude fraction, with the properties shown in Table 2 was used as feed to a hydrocracker.

TABLE 2

| HYDROCRACKER FEED PROPERTIES | |
|---|---|
| Refractive Index @ 75° C. | 1.4970 |
| Density @ 15° C., kg/l | 0.924 |
| Nitrogen, wppm | 2000 |
| Sulphur, wt % | 1.8 |
| Gas Chromatographic-Distillation | |

TABLE 2-continued

| HYDROCRACKER FEED PROPERTIES | |
|---|---|
| 5% off, °C. | 290 |
| 50% off, °C. | 400 |
| 95% off, °C. | 490 |

The hydrocracker was a commercial 2 reactor unit with recycle operating at the approximate conditions presented in Table 3.

TABLE 3

| HYDROCRACKER OPERATING CONDITIONS | |
|---|---|
| Fresh Feed Rate, kB/d | 12 |
| Recycle Rate, kB/d | 12 |
| Pressure, psig | 2100 |
| Hydrogen Treat Rate, scf/B | 9000 |
| R-1 Temperature, °C. | 400 |
| R-2 Temperature, °C. | 380 |

A slip-stream from the recycle was sampled and fractionated to give distillates boiling in the ranges 276°-373° C. and 299°-375° C. (GCD 5/95 LV% points). These distillates were solvent dewaxed using 2 volumes of a 50/50 mixture (vol/vol) of methyl-ethyl-ketone and methyl-isobutyl-ketone, chilled to -24° C. and filtered to separate the wax.

Properties of the dewaxed oils are summarized in Table 4 where they are compared to commercially produced naphthenic transformer base oils made from Venezuelan crude by fractionation, solvent extraction and mild hydrotreatment, and to an extracted-dewaxed Western Canadian Paraffinic distillate.

These hydrocracked basestocks were not hydrofinished. In a commercial operation this might be desirable in order to ensure complete removal of dewaxing solvent residues or other trace contaminants which could affect electrical properties.

TABLE 4

| PROPERTIES OF TRANSFORMER OIL BASES | Hydrocracked-Dewaxed Western Canadian | | Extracted-Hydrofinished Venezuelan | Extracted-Dewaxed Western Canadian |
|---|---|---|---|---|
| | Paraffinic | Distillate | Naphthenic Distillate | Paraffinic Distillate |
| Boiling Range, °C. | 276-373 | 299-375 | 270-410 | 270-415 |
| Viscosity @ 100° C., cSt | 1.96 | 2.11 | 2.2 | 2.45 |
| Viscosity @ 40° C., cSt | 6.33 | 7.20 | 7.97 | 9.13 |
| Pour Point, °C. | −33 | <−36 | −42 | −21 |
| Cloud Point, °C. | −21 | −21 | −39 | −18 |
| COC Flash, °C. | 153 | — | 148 | 152 |
| Sulphur, wt % | <0.01 | <0.01 | 0.20 | 0.07 |
| % Aromatic Carbon by Infra red | 10.3 | 7.5 | 13.2 | 10.2 |

These base oils were treated with 0.08 wt% 2,6 di-t-butyl paracresol anti-oxidant and 0.2 wt% Pearsall OA 100A pour depressant, an alkylated polystyrene.

Performance of these formulated oils in various industry standard tests as well as ASTM and Canadian Standards Associations C-50 standards for transformer oils are presented in Table 5.

The hydrocracked basestock formulations had higher viscosity at −40° C. than the naphthenic base formulation, but easily met the requirement of CSA C50. In the 164 hour ASTM D2440 oxidation test the hydrocracked basestock formulations were better than the naphthenic base formulation, while in the 24 hour test they were poorer, although again they easily met the requirements of CSA C50.

The hydrocracked basestock formulation met ASTM and CSA requirements for transformer oils, while an extracted-dewaxed distillate from a Western Canadian paraffinic crude did not satisfy the kinematic viscosity requirement, thus indicating its unsuitability as a transformer oil. This latter stock was prepared from Western Canadian paraffinic crude similar to the original source of the materials hydrocracked to produce the stock which was formulated into a transformer oil meeting industry standards. Thus it is seen that hydrocracking can be employed as a route for producing an acceptable transformer oil out of a stock which is normally considered unsuitable for use as a transformer oil base stock.

TABLE 5

| PERFORMANCE OF TRANSFORMER OILS* | Hydrocracked-Dewaxed Western Canadian | | Extracted-Hydrofinished Venezuelan | Extracted-Dewaxed Western Canadian | ASTM D 3487 and CSA C-50 |
|---|---|---|---|---|---|
| | Paraffinic | Distillate | Naphthenic Distillate | Paraffinic Distillate | Requirements |
| Viscometrics | | | | | |
| Pour, °C. (ASTM D97) | −45 | −45 | −51 | −51 | −46 max |
| Kinematic Viscosity, cSt @ −40° C. | 2600 | 2600 | 1500 | 15,000 | 6000 max |
| Oxidation Stability | | | | | |
| ASTM D2440 (24 hour) | | | | | |
| Visible Sludge | Nil | Nil | Nil | Nil | Nil |
| Acid Number | 0.02 | 0.04 | Nil | 0.02 | 0.15 max |
| Interfacial Tension dyne/cm | 34 | 24 | 40 | 38 | 20 min |
| ASTM D2440 (164 hour) | | | | | |
| sludge, wt % | 0.05 | 0.05 | 0.12 | 0.10 | 0.3 max |
| Acid Number | 0.24 | 0.21 | 0.46 | 0.30 | 0.6 max |
| Gassing Tendency | | | | | |

TABLE 5-continued

| PERFORMANCE OF TRANSFORMER OILS* | | | | | |
|---|---|---|---|---|---|
| | Hydrocracked-Dewaxed Western Canadian | | Extracted-Hydrofinished Venezuelan | Extracted-Dewaxed Western Canadian | ASTM D 3487 and CSA C-50 |
| | Paraffinic | Distillate | Naphthenic Distillate | Paraffinic Distillate | Requirements |
| ASTM (D2300B) L/min | +1.1 | +10.5 | −28.4 | −4.5 | +30 max |

*formulated with 0.08 wt % di-tert-butyl para-cresol, and 0.2 wt % Pearsall OA 100A pour depressant (alkylated polystyrene)

It is surprising that the unsuitable paraffinic stock can be converted into an acceptable transformer oil by hydrocracking because of the extremely low sulfur content of the hydrocracked stock, leading one to expect an absence of natural oxidation inhibitor and an accompanying unacceptable oxidation performance.

What is claimed is:

1. A process for producing a formulated transformer oil comprising the steps of hydrocracking a paraffinic petroleum hydrocarbon, fractionating the hydrocracked paraffinic petroleum hydrocarbon to recover a distillate boiling in the transformer oil range, solvent dewaxing the fraction boiling in the transformer oil range and adding to the dewaxed oil an effective amount of an additive selected from antioxidants, pour point depressants and mixtures thereof.

2. The process of claim wherein the dewaxed oil is hydrofinished before the addition of the additives.

3. The process of claim 1 or 2 wherein the paraffinic petroleum hydrocarbon which is hydrocracked is a virgin atmospheric distillate, virgin vacuum distillate, distillates obtained from cokers or visbreakers, lube extracts, wax streams and mixtures thereof.

4. The process of claim 1 or 2 wherein the hydrocracked paraffin petroleum hydrocarbon is fractionated into a distillate boiling in the range 270° to 375° C.

5. The process of claim 1 or 2 wherein the solvent dewaxing is to a filter temperature of about −21° C.

6. The process of claim 1 or 2 wherein the anti-oxidant is selected from phenolics, amines, and nitrogen heterocycle metal deactivators.

7. The process of claim 1 or 2 wherein the pour point depressant is selected from alkylated aromatic polymers.

8. The process of claim 1 or 2 wherein the anti-oxidant is used in an amount ranging from about 0.005 to 0.3 wt%.

9. The process of claim 1 or 2 wherein the pour point depressant is used in an amount ranging from about 0.01 to 2.0 wt%.

10. A formulated transformer oil made by the process comprising the steps of hydrocracking a paraffinic petroleum hydrocarbon, fractionating the hydrocracked paraffinic petroleum hydrocarbon to recover a distillate boiling in the transformer oil range, solvent dewaxing the fraction boiling in the transformer oil range and adding to the dewaxed oil an effective amount of an additive selected from anti-oxidants, pour point depressants and mixtures thereof.

11. The formulated transformer oil of claim 10 wherein dewaxed oil is hydrofinished before the addition of the additives.

12. The formulated transformer oil of claim 10 or 11 wherein the paraffinic petroleum hydrocarbon which is hydrocracked is virgin atmospheric distillate, virgin vacuum distillate, distillates obtained from cokers or visbreakers, lube extracts, wax streams and mixtures thereof.

13. The formulated transformer oil of claim 10 or 11 wherein the hydrocracked paraffin petroleum hydrocarbon is fractionated into a distillate boiling in the range of 270° to 375° C.

14. The formulated transformer oil of claim 10 or 11 wherein the solvent dewaxing is to a filter temperature of about −21° C.

15. The formulated transformer oil of claim 10 or 11 wherein the anti-oxidant is selected from phenolics, amines, and nitrogen heterocycle metal deactivators.

16. The formulated transformer oil of claim 10 or 11 wherein the pour point depressant is selected from alkylated aromatic polymers.

17. The formulated transformer oil of claim 10 or 11 wherein the anti-oxidant is used in an amount ranging from about 0.005 to 0.3 wt.%.

18. The formulated transformer oil of claim 10 or 11 wherein the pour point depressant is used in an amount ranging from about 0.01 to 2.0 wt.%.

* * * * *